US007637794B2

(12) United States Patent
Barri et al.

(10) Patent No.: US 7,637,794 B2
(45) Date of Patent: Dec. 29, 2009

(54) BREATH-SENSITIVE TOY

(75) Inventors: Darin Barri, El Segundo, CA (US); Raymond J. Martin, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 58 days.

(21) Appl. No.: 10/660,344

(22) Filed: Sep. 10, 2003

(65) Prior Publication Data

US 2004/0180603 A1 Sep. 16, 2004

Related U.S. Application Data

(60) Provisional application No. 60/410,068, filed on Sep. 11, 2002.

(51) Int. Cl.
*A63H 33/26* (2006.01)

(52) U.S. Cl. ..... 446/175; 446/297; 446/484

(58) Field of Classification Search ..... 446/175, 446/297–303, 397, 268, 369
See application file for complete search history.

(56) References Cited

U.S. PATENT DOCUMENTS

| | | | | |
|---|---|---|---|---|
| 3,703,696 | A | 11/1972 | Browall et al. | |
| 3,721,039 | A * | 3/1973 | Cook et al. | 446/178 |
| 4,328,478 | A | 5/1982 | Murata et al. | |
| 4,450,429 | A | 5/1984 | Murata | |
| 4,768,378 | A | 9/1988 | Ando et al. | |
| 4,993,307 | A | 2/1991 | Sakashita | |
| 5,245,130 | A | 9/1993 | Wheaton et al. | |
| 5,394,883 | A | 3/1995 | Neuman | |
| 5,582,478 | A * | 12/1996 | Ambrosino | 362/234 |
| 5,739,430 | A | 4/1998 | Berberich | |
| 5,820,440 | A | 10/1998 | Truchsess | |
| 6,006,165 | A | 12/1999 | Okada | |
| 6,053,797 | A | 4/2000 | Tsang et al. | |
| 6,055,848 | A | 5/2000 | Weigold | |
| 6,224,455 | B1 * | 5/2001 | Laurienzo | 446/297 |
| 6,230,543 | B1 * | 5/2001 | Froehling et al. | 73/1.06 |
| 6,247,349 | B1 | 6/2001 | Lee et al. | |
| 6,273,421 | B1 | 8/2001 | Thalheimer et al. | |
| 6,342,295 | B1 | 1/2002 | Kobayashi | |
| 6,491,516 | B1 * | 12/2002 | Tal et al. | 431/253 |
| 6,513,164 | B1 * | 2/2003 | Hearns | 5/419 |
| 6,565,407 | B1 | 5/2003 | Woolington et al. | |
| 6,669,527 | B2 | 12/2003 | Tai Chan | |

(Continued)

FOREIGN PATENT DOCUMENTS

DE 19960544 A1 * 7/2001

(Continued)

*Primary Examiner*—Gene Kim
*Assistant Examiner*—Urszula M Cegielnik
(74) *Attorney, Agent, or Firm*—Edell, Shapiro & Finnan LLC

(57) ABSTRACT

A breath-sensitive toy responding with interesting behavior to human breath such as caused by whispering, speaking, singing, or blowing. A processor monitors sensors for detecting humidity or temperature variations due to the proximity of human breath. When the presence of breath is detected, the processor actuates one or more output devices capable of producing sound, light, or movement. The toy can have the form of a figure such as a doll or stuffed toy, or the form of a child's musical toy, such as a pan flute or harmonica.

20 Claims, 4 Drawing Sheets

U.S. PATENT DOCUMENTS

| | | | | |
|---|---|---|---|---|
| 6,712,667 | B1 * | 3/2004 | Melzer et al. | 446/92 |
| 6,891,096 | B2 * | 5/2005 | Guay | 84/331 |
| 6,901,971 | B2 * | 6/2005 | Speasl et al. | 141/1 |
| 2001/0029147 | A1 | 10/2001 | Hornsby et al. | |
| 2001/0031602 | A1 * | 10/2001 | Sagi-Dolev | 446/227 |
| 2001/0041496 | A1 * | 11/2001 | Smirnov | 446/297 |
| 2002/0086607 | A1 * | 7/2002 | Chan | 446/175 |
| 2002/0094746 | A1 * | 7/2002 | Harlev | 446/268 |
| 2003/0130851 | A1 | 7/2003 | Nakakita et al. | |
| 2003/0162161 | A1 * | 8/2003 | Horchler | 434/406 |

FOREIGN PATENT DOCUMENTS

| | | | | |
|---|---|---|---|---|
| JP | 02154784 | A | * | 6/1990 |
| JP | 09304127 | A | * | 11/1997 |
| KR | 1020000007028 | A | | 7/2000 |
| KR | 2000-0015705 | | | 8/2000 |
| WO | WO02/34478 | A | | 5/2002 |

* cited by examiner

BREATH-SENSITIVE TOY

CROSS-REFERENCE TO RELATED APPLICATION

This application claims the benefit of U.S. Provisional Patent Application No. 60/410,068 filed Sep. 11, 2002 whose contents are incorporated herein for all purposes.

FIELD OF THE INVENTION

The present invention relates generally to children's toys. More specifically, the present invention relates to interactive toys programmed to respond to breath, and other forms of human input, with interest-inducing behavior.

BACKGROUND

Various types of interactive toys, including dolls, are well known. Toys that are responsive to a user's actions are desirable because they may enhance the interest and, consequently, the enjoyment of a user during play. The responses of toys in general, and particularly of toy animals and dolls, have conventionally been controlled using one of several standard triggering mechanisms. For example, children's dolls are known that cry or flutter their eyelids when tipped horizontally. It is also common for simple toys to make noise when air is forcefully expelled from them. Other toys are known that recite preprogrammed phrases or play songs when activated by the press of a button or the pull of a string. The sound activating buttons of such toys are often imbedded within them to create a more lifelike effect. For instance, a pressure sensitive button may be placed within the paw of a teddy bear so that the teddy bear plays pleasing music when the paw is squeezed.

The complexity of user-actuated stimuli and their corresponding reactions varies greatly along the spectrum of children's toys. As technology has advanced the responsive capacities of toys have matured as well, replacing squeeze toys and pull-string dolls with others controlled by embedded buttons, pressure sensors, photo sensors, and microphones. Prior publications of interest include U.S. Pat. Nos. 3,703,696; 4,328,478; 4,450,429; 4,768,378; 5,394,883; 5,820,440; and 6,053,797; and U.S. patent application Pub. No. U.S. 2002/0086607 A1, the disclosures of all of which are incorporated herein by reference.

For example, U.S. Pat. No. 5,820,440 to Truchsess discloses a doll with pressure sensors located on its rump. The doll of Truchsess laughs or sings a nursery song when bounced or dandled on a user's knee. Similarly, U.S. Pat. No. 6,053,797 to Tsang et al. discloses a toy figure having multiple mechanical pressure sensors. The toy of Tsang responds in different ways depending on the amount and kind of mechanical stimulation applied.

Regardless of the particular embodiment, it is desirable to develop toys that incorporate sensing and responding means that are able to function together to produce the most realistic behavioral effect possible. Furthermore, the proficiency with which a toy is able to differentiate between and respond to varying inputs is also significant in producing a distinctive and enjoyable play experience. In these capacities, some toys are better equipped than others. For instance, a toy animal that plays a recorded song when a string is pulled is quite different from one that responds to a more lifelike stimulus such as a touch or spoken word.

However, toys that respond to auditory input received through a microphone, such as the doll taught by Chan in U.S. patent application Pub. No. U.S. 2002/0086607 A1, are also affected by certain inherent limitations. It is significant that the microphones in such toys lack the ability to distinguish between human voices and unrelated background noise, since they are activated solely in accordance with the volume of an input. As a result, the performance of such a toy is hindered by its tendency to respond inappropriately when confronted with any extraneous sound that lies within its effective volume range. For this reason, there remains a need in the art to develop toys that incorporate alternative techniques for sensing and responding to user stimuli in order to create an interesting atmosphere of human interaction.

SUMMARY

The present invention provides an interactive toy that senses and responds, among other possible stimuli, to the presence of human breath. In particular, the present invention includes an electronic humidity or airflow sensing apparatus that detects the variation in humidity or temperature accompanying the proximity of human breath with respect to an ambient value, the detection of which causes the toy to respond in a predetermined manner.

DETAILED DESCRIPTION

Figure 1:
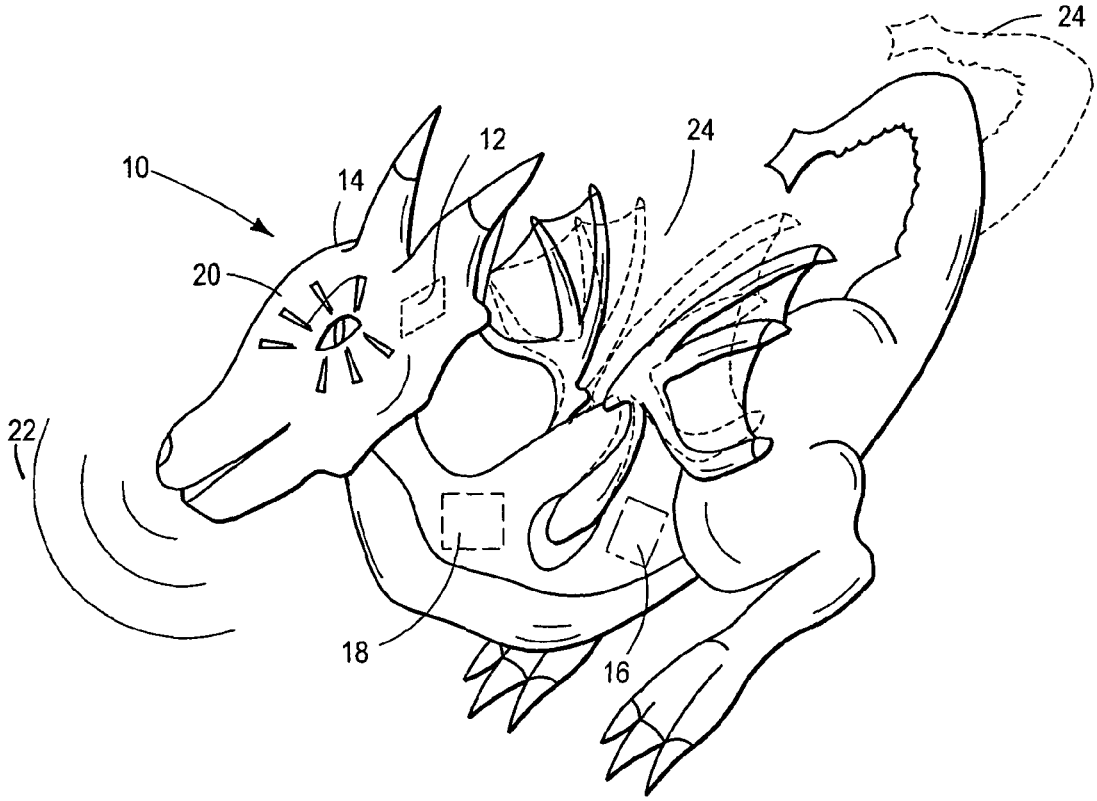
FIG. 1 is a perspective view of a toy illustrating elements in accordance with an embodiment of the present invention.

FIG. 1 shows a toy 10 in the form of a magical dragon having identical left and right breath sensors, 12 and 14, mounted within its head cavity near the location of its ears. Breath sensors 12 and 14 detect when a user of toy 10 breathes near the ears of the dragon, by detecting a change in humidity or temperature at one or both of the sensors. Alternative embodiments may include a single humidity sensor 12 located as desired on or in the dragon, perhaps as a way to reduce the cost of producing toy 10.

The preferred embodiment further includes a reference sensor 16, preferably an additional humidity sensor located elsewhere on toy 10. Sensor 16 measures ambient humidity and produces a reference signal for comparison to signals from either or both of sensors 12 and 14. Reference sensor 16 should be positioned so as to be protected from the moist air to which the other sensors 12 and 14 are exposed, such as on the side of the dragon's torso, under an arm.

A processor 18 is mounted within toy 10 and operatively connected to breath sensors 12 and 14 and reference sensor 16. Processor 18 monitors the electrical characteristics of breath sensors 12 and 14 and reference sensor 16. When a user whispers, speaks, or blows near the ears of toy 10, processor 18 may detect the difference in electrical characteristics caused by the humidity of his or her breath, and may cause toy 10 to produce output in response. Thus, when a positive humidity differential is registered, processor 18 may, in turn, actuate an appropriate preprogrammed output.

Toy 10 may respond to user input in a variety of output modes, as shown in FIG. 1. Its eyes may light up or glow, as shown at 20. Toy 10 may produce sounds 22, particularly speech sounds or singing, by means of a speaker or other sound transducer located in or near its mouth. It may move its tail or wings, as shown at 24, or even its claws. Combinations of these output modes are also possible, as described further below.

For instance, in keeping with the embodiment of FIG. 1, toy 10 may, when turned on, audibly prompt a user to move closer and speak into its ear. Breath sensors 12 and 14 are located near the ears of toy 10 for purposes of realism. When a breath sensor (12 or 14) indicates that a user has performed the indicated action, toy 10 may proceed with the recitation of an entertaining story, the telling of which is intermixed with further prompts for the user. If, for example, toy 10 fails to sense that a user has complied with its requests, it may churn the air with its claws and wings 24, flash light from its eyes 20, and emit a roar from its mouth 22, followed by a repeated exhortation to the user to perform the previously indicated action. These behavioral characteristics may be achieved as desired by including appropriately located motorized or mechanically actuated limbs, light emitting diodes or other light emitting devices, and a speaker with prerecorded sound clips to be controlled by processor 18 in a manner as would be understood by one of ordinary skill in the art.

As taught, toy 10 may initiate interaction with a user by audibly requesting a particular user input when its power switch is turned on. Because sensors 12 and 14 are able to discern the presence of speech, but not its meaning, toy 10 does not preferably ask "yes" or "no" type questions. Rather, the manner of prompt most fittingly played by toy 10 is of the general form: "speak into my ear if . . . ." In order to conserve power, toy 10 may automatically enter a "sleep" mode after operating for a predetermined amount of time without receiving additional user input. Subsequently, the "sleep" mode may be cancelled and the toy returned to full operating power when a user next activates breath sensor 12 or 14.

Figure 2:
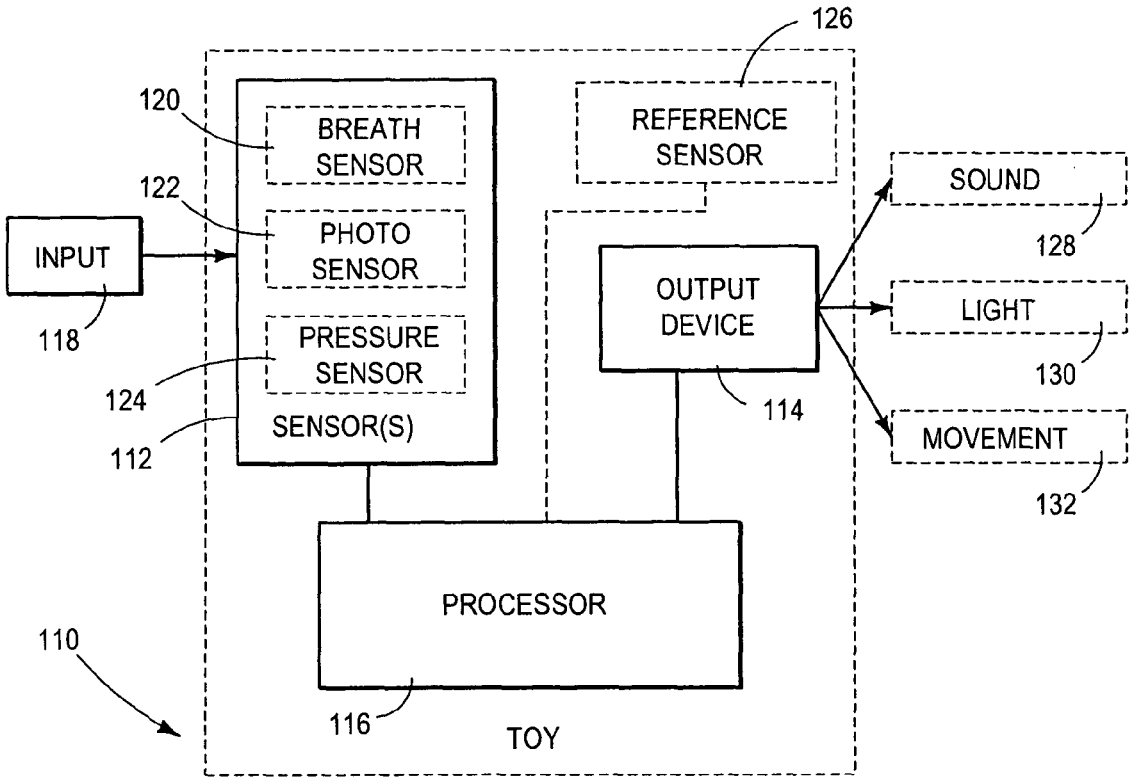
FIG. 2 is a block diagram showing elements of another embodiment of the present invention.

FIG. 2 shows a block diagram of another embodiment of the invention. Toy 110 includes sensors 112 for input, device or transducer 114 for output, and processor 116 operatively connected to sensors 112 and output device 114. Input 118 caused by a user's actions is registered by one or more of sensors 112. Sensors 112 may include a breath sensor 120, a photo sensor 122, or a pressure sensor 124. In the case that sensors 112 include a breath sensor, toy 110 may also include a reference sensor 126 operatively connected to processor 116. When sensors 112 include breath sensors only, the block diagram shown in FIG. 2 is appropriate to the embodiment of FIG. 1. Output device 114 may produce sound 128 through a speaker. Alternatively or in addition, device 114 may produce light 130 by means of incandescent lamps, LEDs, or other electrically activated light emitting devices as known in the art. Similarly, device 114 may produce movement 132 for example through mechanical actuators for limbs or other appendages.

Figure 3:
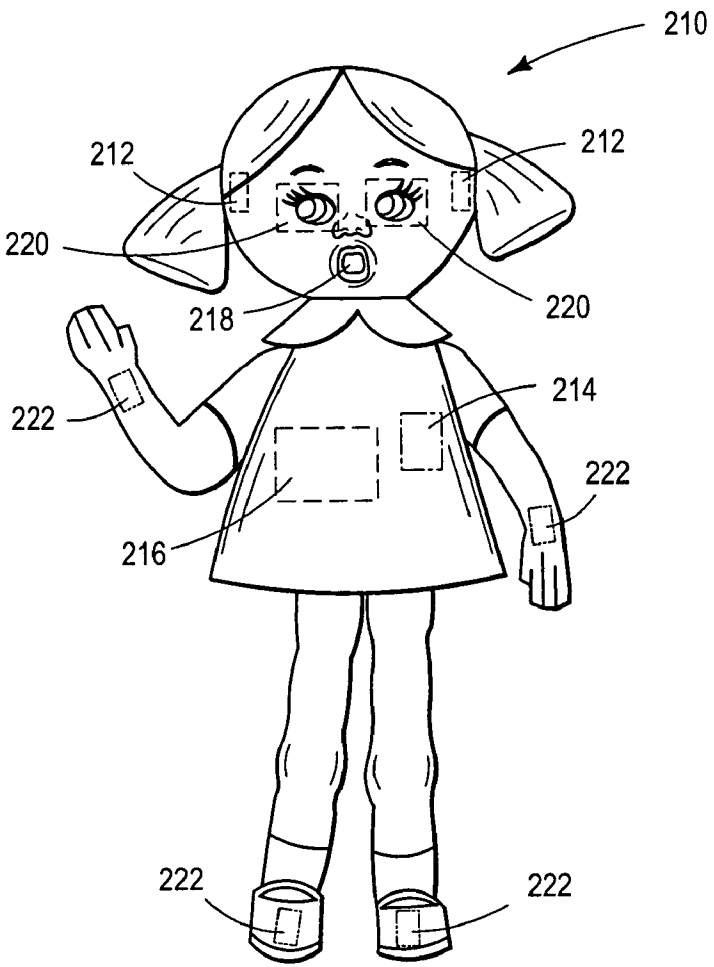
FIG. 3 is a perspective view of a stuffed toy illustrating elements in accordance with a third embodiment of the present invention.

In another embodiment of the invention, shown in FIG. 3, a children's doll 210 is equipped with breath sensors 212, a reference sensor 214, a processor 216, and a speaker 218 as previously taught with reference to toy 10. Doll 210 is programmed to initiate dialogue with a child by playing prerecorded phrases tailored to prompt response from the child. Doll 210 may request that the child lean closer and whisper a secret in its ear. When the child does so, his or her breath is detected by breath sensors 212 and doll 210 may respond appropriately. In this manner, the programmed responses of doll 210 allow it to carry on a seemingly confidential whispered conversation with the user, producing an atmosphere of playful companionship for the child.

Such a doll, in keeping with the present invention, also has the capability of playing pleasant songs, along with which the user may be prompted to sing. Breath sensors 212 may indicate whether or not the child is singing along simultaneously with the doll 210 by detecting the presence of the child's breath. In the event that the child is singing as well, speaker 218 may play such a phrase as, "Good job, now let's sing . . . ." Likewise, if the breath sensors 212 fail to detect singing, doll 210 may respond, "I can't hear you—please continue singing in my ear." In this general manner, a doll in accordance with the present invention may provide an ideal sing-along buddy for a young child.

Figure 4:
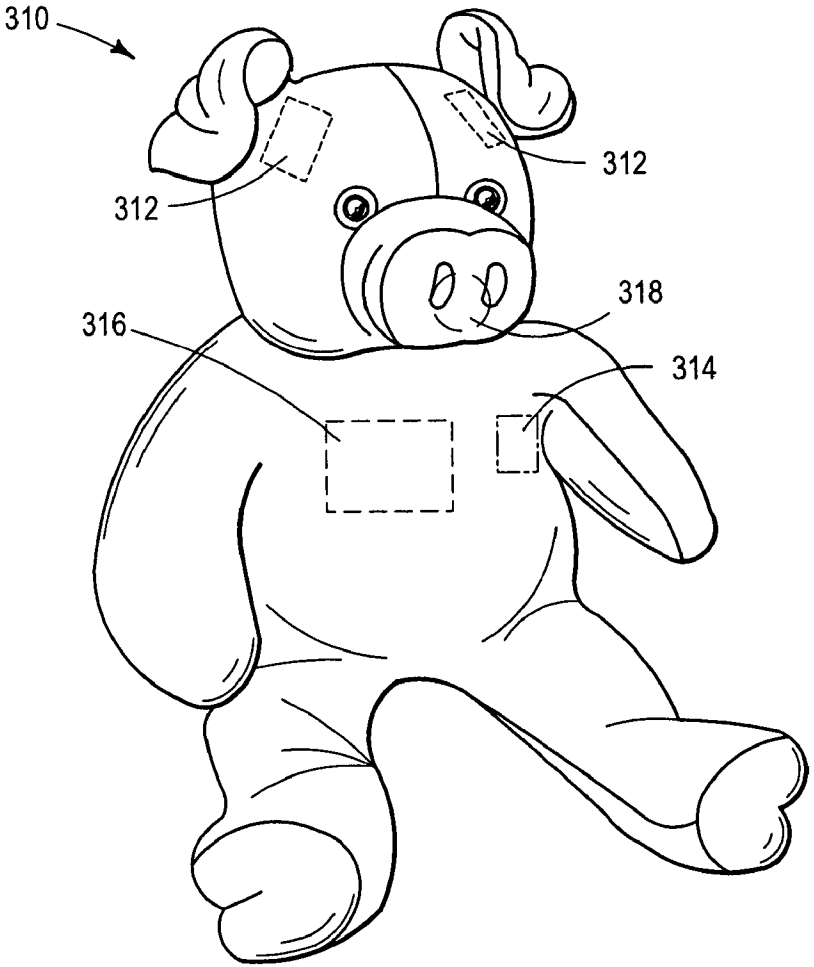
FIG. 4 is a perspective view of a doll illustrating elements in accordance with a fourth embodiment of the present invention.

Referring now to FIG. 4, a stuffed animal toy such as a pig may serve as another embodiment of the present invention. For instance, stuffed pig 310, containing breath sensors 312, reference sensor 314, processor 316, and speaker 318 as previously taught, may be preprogrammed with interactive stories such as "The Three Little Pigs". Pig 310 may prompt a user to whisper into its ear if he or she would like to hear a story. As with other embodiments of the invention, pig 310 may pause in the course of its story telling with additional prompts for the user. For instance, pig 310 may request that the child speak certain repetitive phrases into its ear, such as: "Not by the hair on my chinny-chin-chin." When the breath sensors indicate the child's compliance, pig 310 may respond with affirmative feedback. Conversely, when the sensors 312 fail to detect the anticipated presence of breath, pig 310 may voice an inquiry into the child's failure to respond, followed by repeated urging to participate in the story.

Embodiments of the present invention are intended to fully utilize the receptive capabilities of breath sensors. For this reason, they may elicit a variety of detectable user responses as fitting within the contexts of particular applications. For example, pig 310 may, in telling the story of "The Three Little Pigs", request that the user try to "huff and puff and blow the house down". If the child blows near one of the pig's breath sensors 312, pig 310 may detect the action and respond accordingly. In this manner, the embodiment may take advantage of the full range of utility possessed by the sensors by prompting users to whisper, speak, or blow as appropriate in each interactive scenario.

Figure 5:
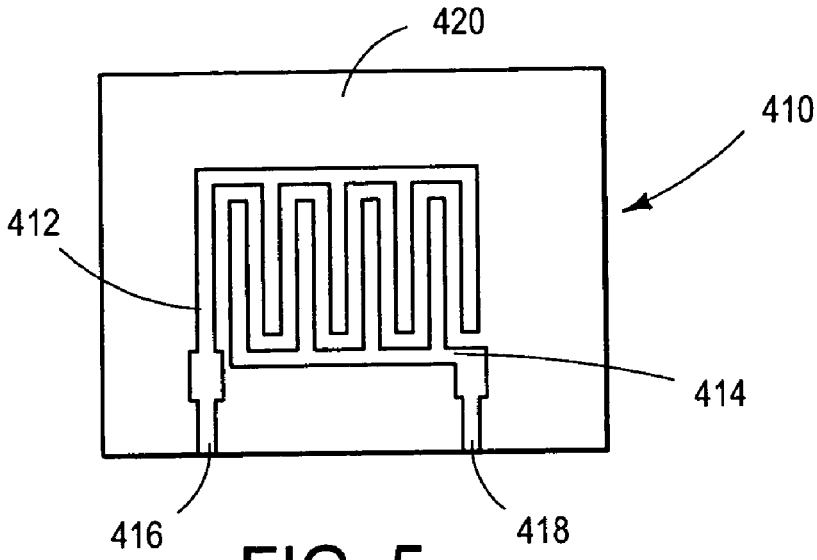
FIG. 5 is a plan view of a humidity sensor which may be utilized in accordance with an embodiment of the present invention.

In keeping with a preferred embodiment of the present invention, humidity sensors 12 and 14, as well as reference sensor 16, may be of the type disclosed in U.S. Pat. No. 3,703,696 to Browall et al. As depicted in FIG. 5, such sensors include an electrically insulating substrate 410, a pair of separate but interdigitated electrodes 412 and 414 on one surface of the substrate, an electrical lead 416 contacting electrode 412, an electrical lead 418 contacting electrode 414, and a thin film 420 of chloromethylated quaternized polystyrene containing from 3.3 to 8.6 percent chlorine. The electrical resistivity of each sensor is highly dependent upon its ambient relative humidity. As a result, when a user breathes upon sensor 12 or 14, the moisture in his or her breath raises the relative humidity surrounding the sensor and results in an immediate decrease in the resistance across the gap between its electrodes. The decreased resistance of electrical sensor 12 or 14 with respect to reference sensor 16 signifies the completion of an anticipated action by the user and triggers a corresponding response on the part of toy 10. It is to be understood that other preferred embodiments of the present invention may incorporate alternative humidity sensing devices, such as those taught in U.S. Pat. Nos. 4,328,478, 4,450,429, and 4,768,378 to Murata et al., Murata, and Ando et al., respectively.

Figure 6:
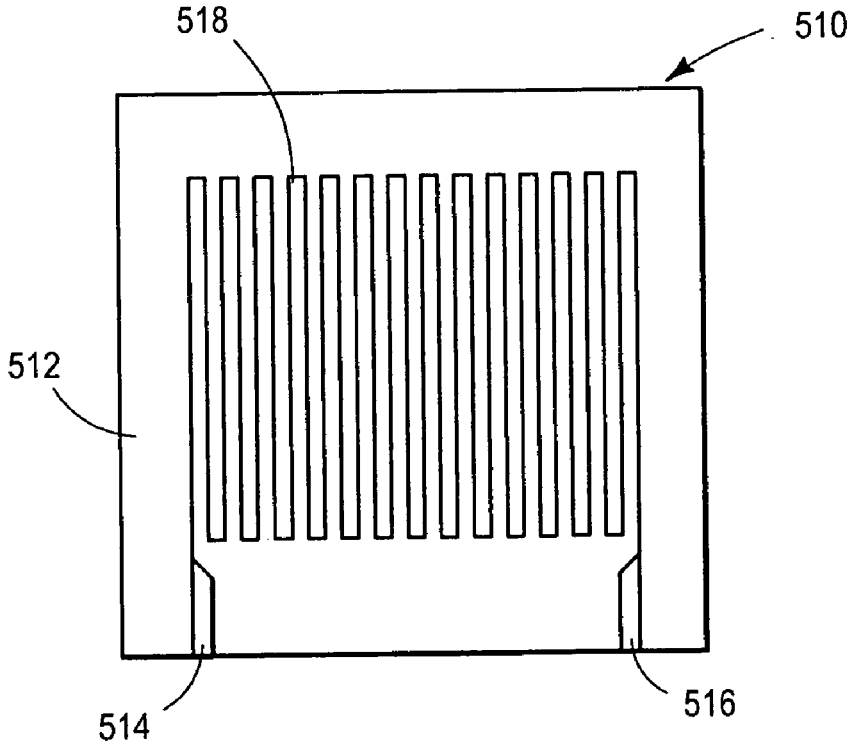
FIG. 6 is a plan view of a temperature sensor which may be utilized in accordance with an embodiment of the present invention.

Embodiments of the present invention may, alternatively, include a sensor such as the one taught in U.S. Pat. No. 5,394,883 to Neuman. The Neuman device provides multiple thermoresistive elements, each of which may function as a flow sensor. One such sensor is shown in FIG. 6. The sensor 510 of FIG. 6 includes an insulating substrate 512 such as polyimide or polyester. Wide conducting paths 514 and 516 are deposited on the substrate to serve as electrodes. Between electrodes 514 and 516 is deposited a long, thin thermoresistive element 518. The temperature change effected by the air flow past thermoresistive element 518 causes a change in its electrical resistance with respect to an ambient or reference value. This functional characteristic allows for not only the indication, but also the quantization, of airflow past thermoresistive element 518.

The sensory device, when utilized in conjunction with a processor as previously taught, may provide very desirable capabilities for use in accordance with the present invention. For example, while useful in an embodiment such as toy 10, a sensor system of the type taught by Neuman having multiple thermoresistive elements may also be ideally implemented in a children's toy such as a pan flute, as shown in FIG. 7, or harmonica, as shown in FIG. 8.

Figure 7:
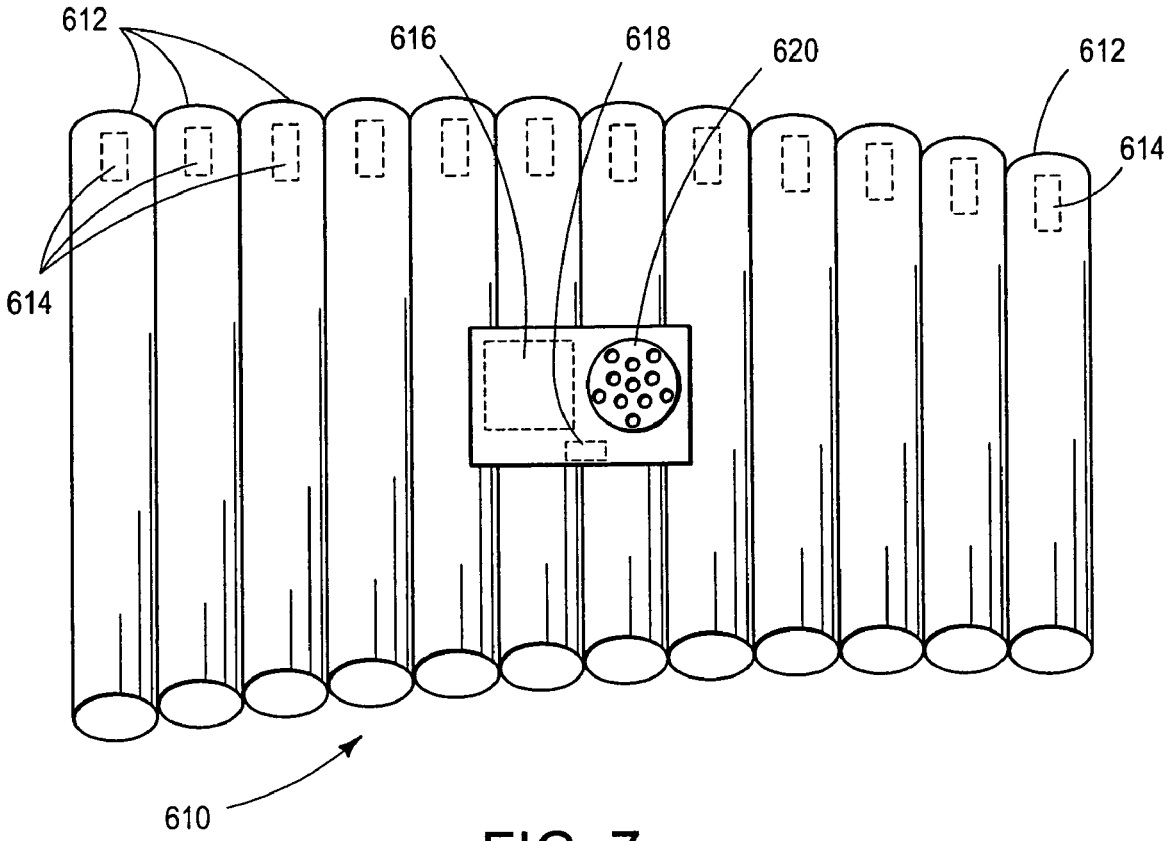
FIG. 7 is a perspective view of a musical toy illustrating elements in accordance with a fifth embodiment of the present invention.

Referring now to FIG. 7, a pan flute 610 includes a number of cylindrical channels 612. In this embodiment, a thermoresistive element 614 may be placed in each channel 612 of pan flute 610, the activation of which causes a signal to be sent to a processor 616, resulting in the corresponding emission of an audible tone at an appropriate musical pitch. Alternatively, the result of activation of a thermoresistive element in a channel could be the corresponding emission of a prerecorded sound, for example, one made by a barnyard animal. A reference thermoresistive sensor may be placed outside a channel, as shown at 618. The capacity of thermoresistive sensor 614 to register the quantity, as well as the existence, of airflow through each orifice allows for the processor's production of tones of varying volume, as well as pitch. In this manner, tones may be played from a speaker 620 in proportion to the force with which a user blows into a respective orifice of instrument 610.

Figure 8:
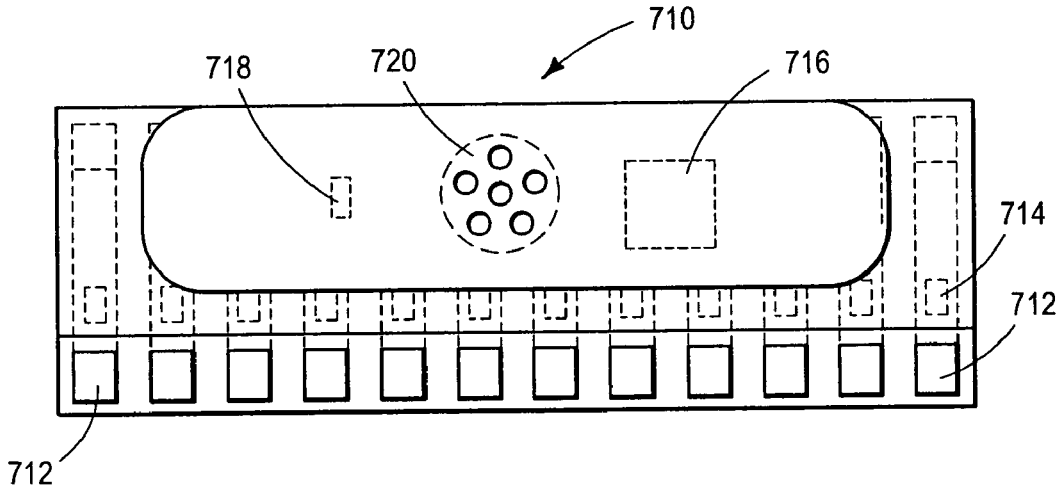
FIG. 8 is a perspective view of another musical toy illustrating elements in accordance with a sixth embodiment of the present invention.

Referring now to FIG. 8, a harmonica 710 includes a number of channels 712. As in the previously discussed embodiment, a thermoresistive element 714 may be placed in each channel 712 of harmonica 710, the activation of which causes a signal to be sent to a processor 716, resulting in the corresponding emission of an audible tone at an appropriate musical pitch, or perhaps a prerecorded sound. A reference thermoresistive sensor may be placed outside a channel, for example at 718. The capacity of thermoresistive sensor 714 to register the quantity, as well as the existence, of airflow through each orifice allows for the processor's production of tones of varying volume, as well as pitch. In this manner, tones may be played from a speaker 720 in proportion to the force with which a user blows into a respective orifice of instrument 710.

In another embodiment, the humidity or airflow sensors taught previously may be utilized in conjunction with additional sensors of different types in order to provide more diverse interactive capabilities on the part of the toy. For instance, an embodiment of the present invention may incorporate, in addition to humidity or airflow sensors, pressure sensors as taught by Truchsess in U.S. Pat. No. 5,820,440, as well as photo sensors as taught by Chan in U.S. patent application Pub. No. US 2002/0086607 A1. Such a combination of different sensory devices in a single toy, when constructed with a processor and communication means as previously taught, provides for complex and varied interactive scenarios.

For example, referring back to FIG. 3, doll 210 may have, in addition to breath sensors 212 near its ears, photo sensors 220 near its eyes, and pressure sensors 222 on its hands and feet. Doll 210 in this case has the capacity to prompt a child to do such things as shake its left hand, kiss its cheek, or whisper into its right ear, and to respond in accordance with the child's actions. Such a doll may be instrumental in teaching a child the names of common body parts, as well as the ability to discern between "right" and "left", and may provide positive feedback when the user successfully accomplishes requested tasks. Additionally, a doll with such diverse sensors may also function as an electronic game by prompting a user or users to complete similar tasks within a certain time constraint, in a manner similar to the traditional "Simon Says" game.

The invention has been described with reference in particular to a preferred embodiment of the invention. It will be apparent to those skilled in the art, however, that many variations and modifications are possible without departing from the spirit and scope of the present invention. For example, as described above, the toy could be a stuffed pig or doll. Alternatively, the invention may be embodied in a toy having channels and capable of producing a variety of sounds depending on which channel is blown into. It is intended that the present invention be limited only as indicated by the scope of the following claims.

What is claimed is:

1. A toy, comprising:

a body;

a breath sensor, the breath sensor being coupled to the body at a first location, the breath sensor being configured to detect the presence of breath proximate to the first location by detecting the value of one of humidity and temperature proximate to the body, the breath sensor being configured to generate an electrical characteristic relative to the value detected by the breath sensor;

a reference sensor, the reference sensor being coupled to the body at a second location, the second location being spaced apart from the first location, the reference sensor in the second location being protected from any breath to which the breath sensor at the first location is exposed, the reference sensor being configured to detect the value of one of humidity and temperature proximate to the body and to generate its own electrical characteristic relative to the value detected by the reference sensor;

an output device, the output device being configured to produce an output; and a processor, the processor being operatively coupled to the breath sensor, to the reference sensor, and to the output device, the processor being configured to compare the electrical characteristic of the breath sensor to the electrical characteristic of the reference sensor, the processor being configured to activate the output device if the electrical characteristics of the breath and reference sensors differ by a predetermined amount.

2. The toy of claim 1, wherein the output device is configured to generate an audible output, and activation of the output device results in the generation of an audible output.

3. The toy of claim 2, wherein the difference between the electrical characteristic of the breath sensor and the electrical characteristic of the reference sensor is created by the presence of a user's breath proximate to the breath sensor, the presence of breath being an input by a user and the audible output being generated in response to the user input.

4. The toy of claim 1, wherein the output device is configured to generate a visual output, and activation of the output device results in the generation of a visual output.

5. The toy of claim 1, wherein the output device is configured to generate a mechanical output, and activation of the output device results in the generation of a mechanical output.

6. The toy of claim 5, wherein the body includes a part movable relative thereto, the mechanical output comprising movement of the movable part relative to the body.

7. The toy of claim 1, wherein the breath sensor includes a humidity sensor and the value detected by the breath sensor is humidity.

8. The toy of claim 1, wherein the breath sensor includes a temperature sensor and the value detected by the breath sensor is temperature.

9. The toy of claim 1, wherein the body resembles a character, the first location is proximate to a head of the character, and the second location is disposed away from the head of the character.

10. The toy of claim 1, wherein the body resembles a musical instrument which includes at least two channels into which air can be introduced, the first location being disposed within one of the channels.

11. A breath-sensitive toy, comprising:

a first sensor, the first sensor being positioned at a first location on the toy, the first sensor being configured to generate an electrical characteristic in response to the presence of breath proximate to the first sensor;

a second sensor, the second sensor being positioned at a second location on the toy, the second location being spaced apart from the first location, the second sensor being located so that it is protected from air exposure, the second sensor being configured to generate an electrical characteristic in response to the detection of ambient conditions proximate to the second sensor, the second sensor being positioned to be exposed to different ambient conditions than the first sensor;

an output device; and a processor, the processor being connected to the first sensor, to the second sensor and to the output device, the processor being configured to compare the electrical characteristic of the first sensor and the electrical characteristic of the second sensor, the processor activating the output device when the electrical characteristic of the first sensor exceeds the electrical characteristic of the second sensor by a predetermined amount.

12. The breath-sensitive toy of claim 11, wherein the output device produces a visual output.

13. The breath-sensitive toy of claim 11, wherein the output device includes a mechanical actuator.

14. The breath-sensitive toy of claim 11, wherein the output device includes a speaker, and the toy is configured to initiate dialogue with a user by playing a prerecorded phrase.

15. The breath-sensitive toy of claim 11, wherein the first sensor includes a humidity sensor and the second sensor includes a humidity sensor.

16. The breath-sensitive toy of claim 11, wherein the first sensor includes a temperature sensor and the second sensor includes a temperature sensor.

17. A toy, comprising:

a body;

a breath sensor coupled to the body at a first location, the breath sensor detecting the presence of breath proximate to the first location by detecting the value of one of humidity and temperature proximate to the body, the breath sensor generating an electrical characteristic relative to the value detected by the breath sensor;

a reference sensor coupled to the body at a second location, the second location being spaced apart from the first location, the reference sensor in the second location being protected from any breath to which the breath sensor at the first location is exposed, the reference sensor detecting the value of one of humidity and temperature proximate to the body and to generate its own electrical characteristic relative to the value detected by the reference sensor;

an output device being configured to produce an output; and a processor operatively coupled to the breath sensor, to the reference sensor, and to the output device, the processor comparing the electrical characteristic of the breath sensor to the electrical characteristic of the reference sensor, the processor activating the output device when the electrical characteristic of the breath sensor exceeds the electrical characteristic of the reference sensor by a predetermined amount.

18. The toy of claim 17, wherein activation of the output device results in the generation of an audible output.

19. The toy of claim 18, wherein the difference between the electrical characteristic of the breath sensor and the electrical characteristic of the reference sensor is created by the presence of a user's breath proximate to the breath sensor, the presence of breath being an input by a user and the audible output being generated in response to the user input.

20. The toy of claim 17, wherein the breath sensor includes a humidity sensor and the value detected by the breath sensor is humidity.

* * * * *

UNITED STATES PATENT AND TRADEMARK OFFICE

CERTIFICATE OF CORRECTION

PATENT NO. : 7,637,794 B2
APPLICATION NO. : 10/660344
DATED : December 29, 2009
INVENTOR(S) : Barri et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 243 days.

Signed and Sealed this

Ninth Day of November, 2010

David J. Kappos

David J. Kappos
*Director of the United States Patent and Trademark Office*